United States Patent [19]

Schieferly

[11] Patent Number: 4,990,104

[45] Date of Patent: Feb. 5, 1991

[54] SNAP-IN RETENTION SYSTEM FOR COAXIAL CONTACT

[75] Inventor: Stephen B. Schieferly, Harrisburg, Pa.

[73] Assignee: AMP Incorporated, Harrisburg, Pa.

[21] Appl. No.: 531,212

[22] Filed: May 31, 1990

[51] Int. Cl.[5] ..... H01R 13/00

[52] U.S. Cl. ..... 439/578; 439/752

[58] Field of Search ..... 439/578, 585, 686, 688, 439/691, 733, 752

[56] References Cited

U.S. PATENT DOCUMENTS

| | | | |
|---|---|---|---|
| 3,525,973 | 8/1970 | Kipnes | 439/578 |
| 3,670,293 | 6/1972 | Garver | 339/177 |
| 4,596,435 | 6/1986 | Bickford | 439/578 |
| 4,611,880 | 9/1986 | Peterssen et al. | 439/752 |
| 4,749,373 | 6/1988 | Brekosky et al. | 439/595 |
| 4,846,711 | 7/1989 | Kobler et al. . | |

*Primary Examiner*—Joseph H. McGlynn
*Attorney, Agent, or Firm*—David L. Smith

[57] ABSTRACT

In accordance with the present invention, an electrical connector 20 has a dielectric housing for receiving at least one coaxial contact 60. The housing has at least one coaxial contact receiving passage 48 and a pair of tines 50 extending angularly toward the profile of each other into the profile of the passage 48. A coaxial contact 60 is received and secured in the passage 48. The coaxial contact 60 has an electrically conductive shell 72 with an electrically isolated concentric center contact 66 therein. The shell 72 has a surface 88 facing rearwardly of the contact 60. The surface 88 is adapted to engage ends 56 of the tines 50 to releasably secure the coaxial contact 60 in the passage 48. Alternate embodiment plug and receptacle contacts are disclosed for power applications.

23 Claims, 9 Drawing Sheets

SNAP-IN RETENTION SYSTEM FOR COAXIAL CONTACT

BACKGROUND OF THE INVENTION

This invention relates to retaining coaxial contacts in an electrical connector, and in particular to a crimp snap retention system for releasably securing coaxial contacts in an electrical connector.

There is disclosed in U.S. Pat. No. 3,670,293 lances on the outer conductor of a coaxial contact to removably mount a coaxial contact in a housing. As the coaxial contact is pressed into a passage of a housing from the rear, the spring lances flex inwardly and slide along the walls of the passage. When the proper insertion depth has been reached, such as when detentes engage a stop shoulder, the spring lances resile radially outward such that the trailing edges align with respective shoulders. Should the coaxial contact be moved in a direction opposite to insertion, the trailing edges of the lances engage shoulders and prevent removal of the coaxial contact. To remove the coaxial contact, a tool is inserted into the front of the passage in which the coaxial contact was received. The tool passes between the outer surface of the outer conductor and the passage wall to press the spring lances inwardly, thereby releasing them from shoulders and permitting the coaxial contact to be withdrawn from the passage. To provide space between the outer surface of the outer conductor and the passage wall for insertion of the removal tool permits the coaxial contact to become axially misaligned in the passageway.

U.S. Pat. No. 4,846,711, the disclosure of which is hereby incorporated by reference, discloses a coaxial contact having flanges along a seam in the outer shell for releasably securing the coaxial contact in a housing. The flanges extend rearward of the insertion direction and collectively diverge in a direction opposite to the direction of insertion. The flanges flex inwardly toward each other as they pass through a restriction in the housing when the coaxial contact is inserted thereinto. As the trailing edges of the flanges pass through the restriction, the flanges resile outwardly such that the trailing edges are aligned with respective shoulders. Should the coaxial contact be moved in a direction opposite to insertion, the trailing edge of the flanges engage the shoulders thereby preventing removal of the coaxial contact. To remove the coaxial contact, a tool is inserted from beneath the housing, perpendicular to the axis of the contact, to press the trailing edges of the flanges toward each other such that the flanges will pass back through the restriction as the coaxial contact is moved rearward of the insertion direction and out of the housing.

A snap-in retention system for pin or socket contacts is disclosed in U.S. Pat. No. 4,749,373.

It would be desirable to have an improved system for releasably mounting and securing a coaxial contact in a housing that maintains the axial alignment of the contact with respect to the housing and the aperture in which the coaxial contact is mounted.

SUMMARY OF THE INVENTION

In accordance with the present invention, an electrical connector has a dielectric housing for receiving at least one coaxial contact. The housing has at least one coaxial contact receiving passage and a pair of frustoconical tines extending angularly toward each other into the profile of the passage. The coaxial contact has an electrically conductive shell with an electrically isolated concentric center contact therein. The shell has a surface facing rearwardly of the contact. Upon insertion of the contact into a passage, the tines flex radially outwardly until the rearwardly facing surface passes the ends of the tines whereupon the tines resile inwardly. The surface is adapted to engage ends of the tines to releasably secure the coaxial contact in the passage.

DESCRIPTION OF THE PREFERRED EMBODIMENT

Figure 8:
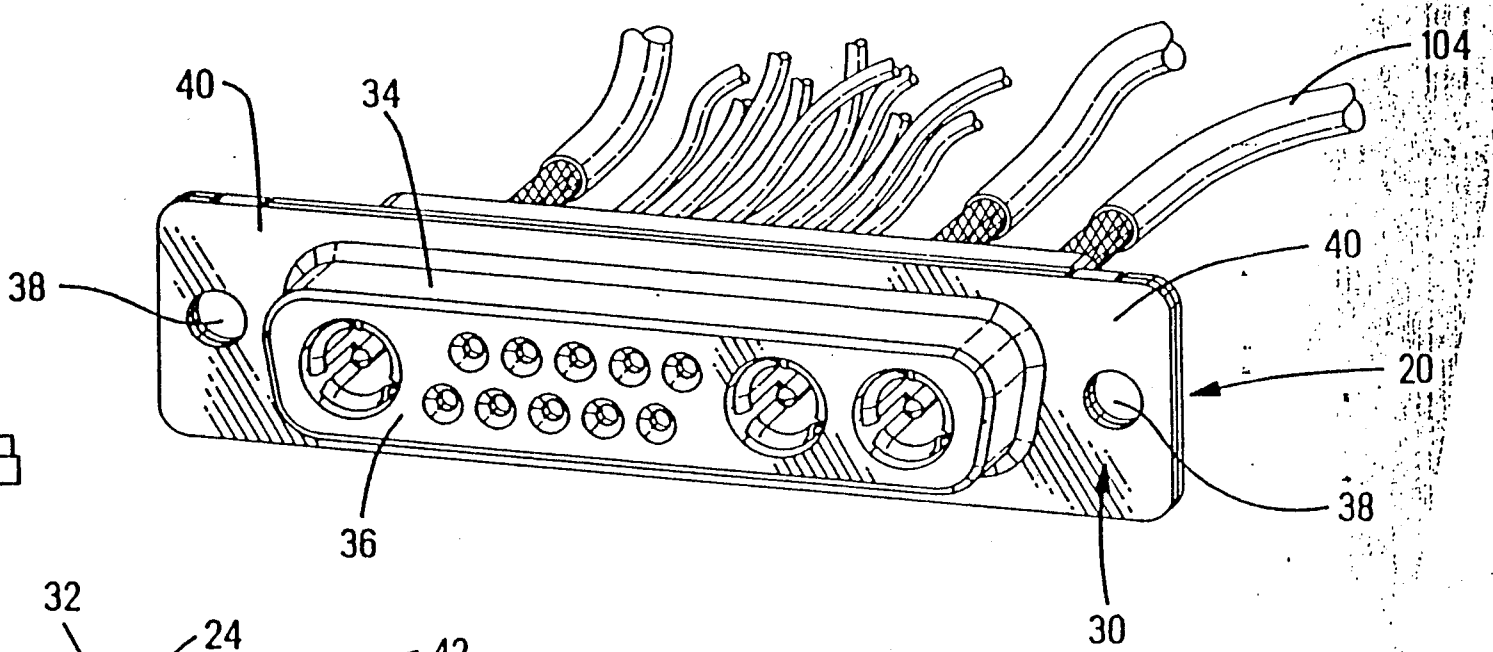
FIG. 8 is a front perspective view of a coax mix receptacle connector.
Figure 9:
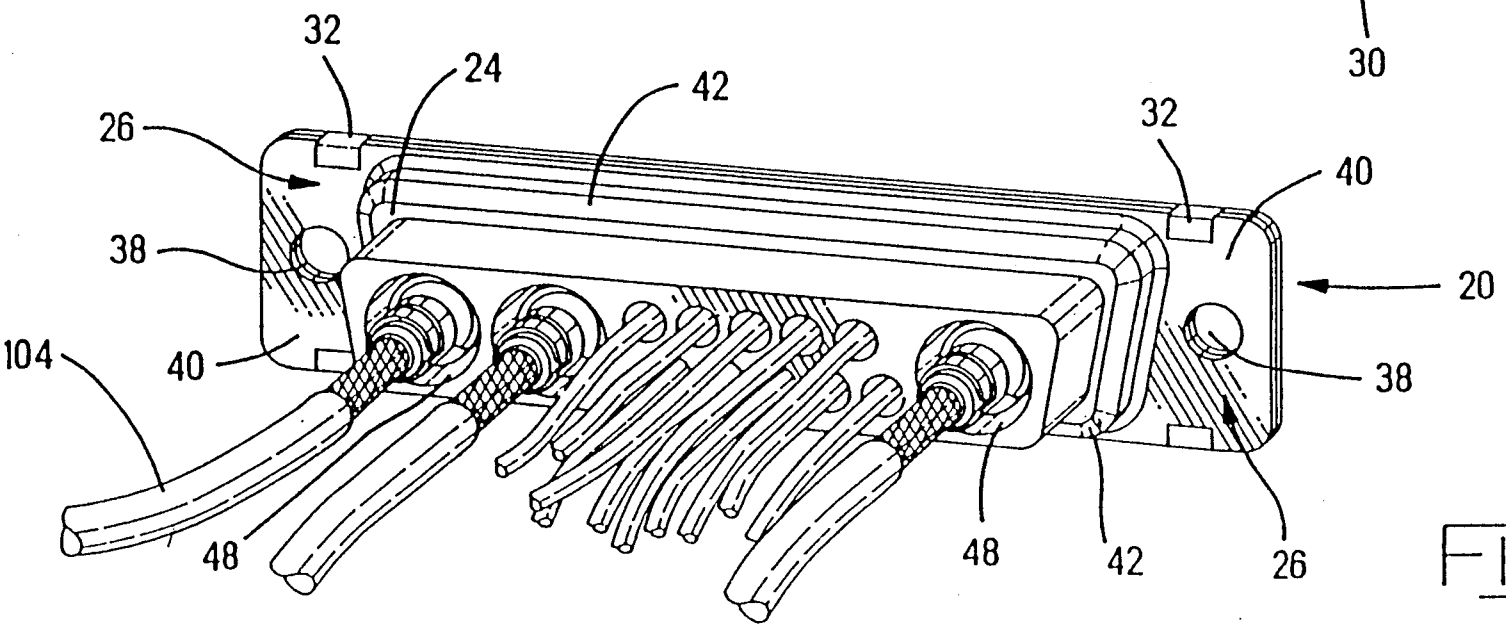
FIG. 9 is a rear perspective view of a coax mix receptacle connector.
Figure 10:
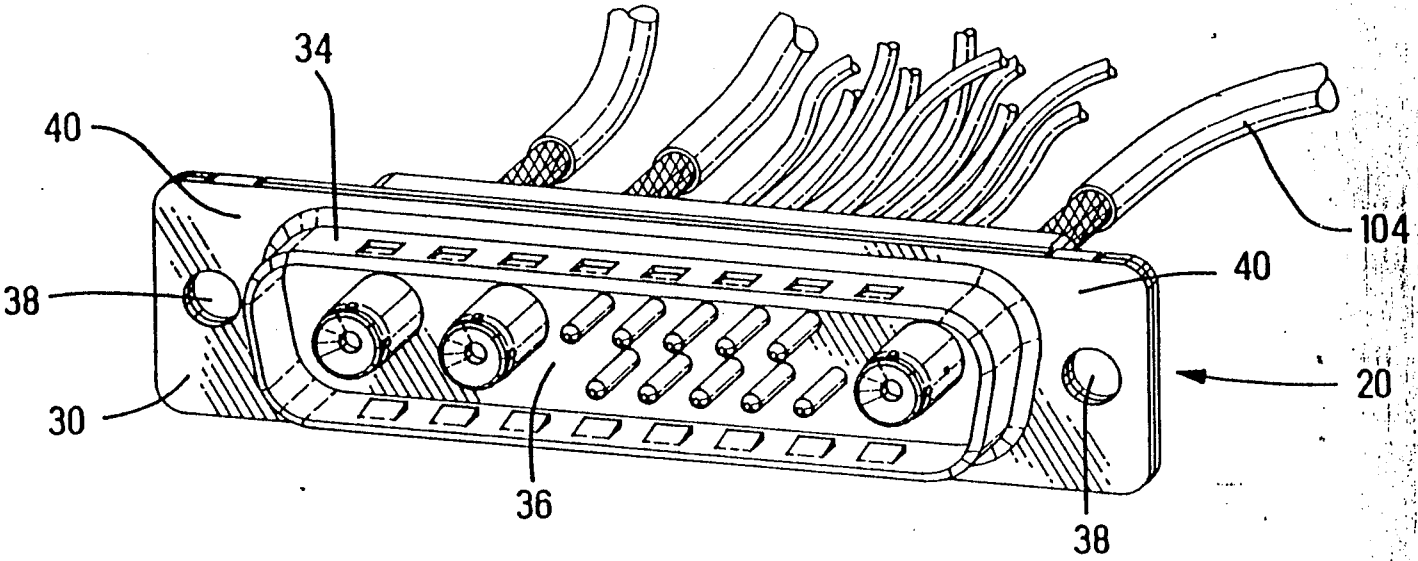
FIG. 10 is a front perspective view of a coax mix plug connector.
Figure 11:
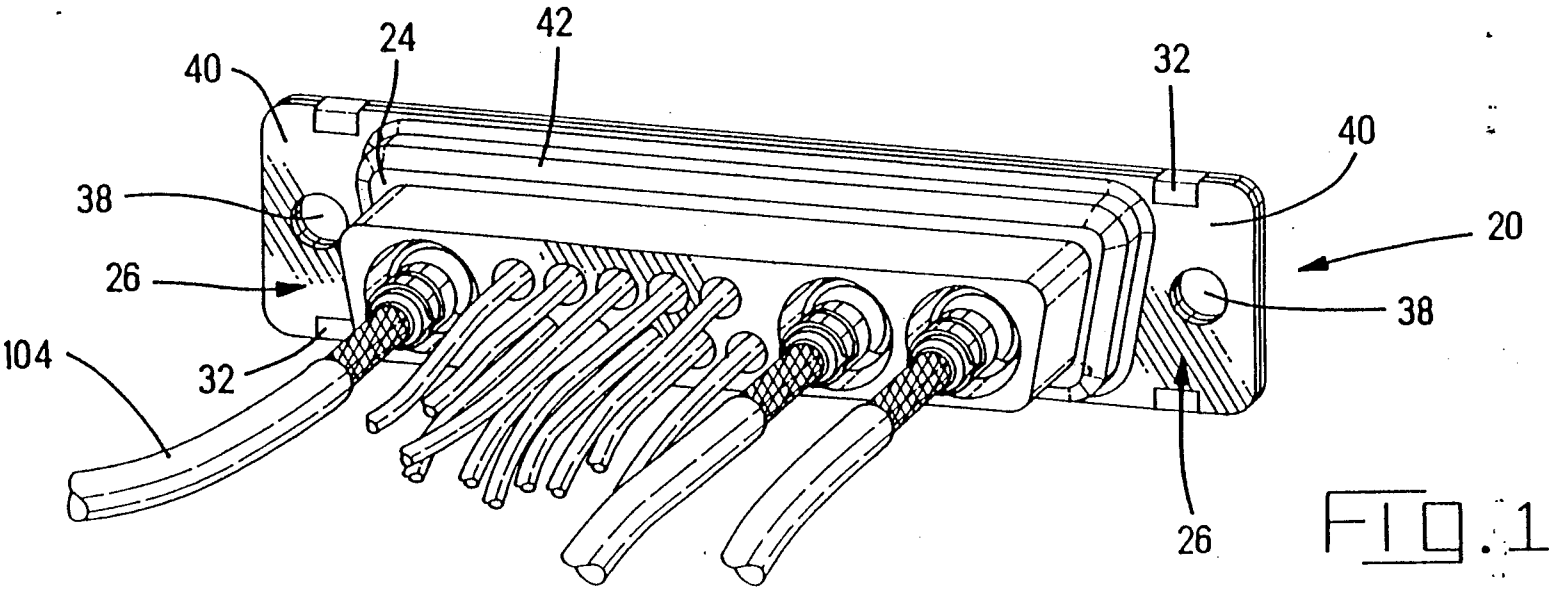
FIG. 11 is a rear perspective view of a coax mix receptacle connector.

Referring to the drawing, initially to FIGS. 8 and 10, there is shown a perspective view of a coax mix connector 20 in accordance with the present invention. Connector 20 may be either a receptacle connector as shown in FIGS. 1, 6, 8 and 9 or a plug connector as shown in FIGS. 2, 7, 10 and 11. In a preferred embodiment, connector 20 comprises an insulative rear insert 22 received in an aperture 24 in rear shell member 26. Insulative forward insert 28 is received in rear shell member 26 and secured therein by forward shell member 30. Rear shell member 26 and forward shell member 30 are mechanically and electrically secured together by tabs 32 folded over an edge of rear shell member 26. Inserts 22 and 28 are referred to as a housing.

Forward shell member 30 has a forwardly extending shroud 34 having the shape of a subminiature D connector. Shroud 34 surrounds mating face 36 to shield contacts within the shroud. Shroud 34 engages the shell of a complementary connector to electrically common shielding therebetween when connector 20 is mated to a complementary shielded connector. Rear and forward shell members 26,30 have aligned apertures forming mounting apertures 38 in integral flanges 40.

Although connector 20 of the preferred embodiment is described with a forward and rear insert, these members could stand alone without a shield and comprise a connector. The two members could be secured together in a known manner and have an integral mounting flange with a mounting aperture therein, or possibly be molded as a single housing.

Rear insert 22 is secured in aperture 24 of rear shell member 26 by flange 42 extending around the periphery of aperture 24. Rear insert 22 has a rear face 44 and a forward face 46 with a plurality of contact receiving passages 48 extending therebetween. Extending upwardly around the periphery of forward face 46 is flange 52 having upper surface 54.

Figure 2:
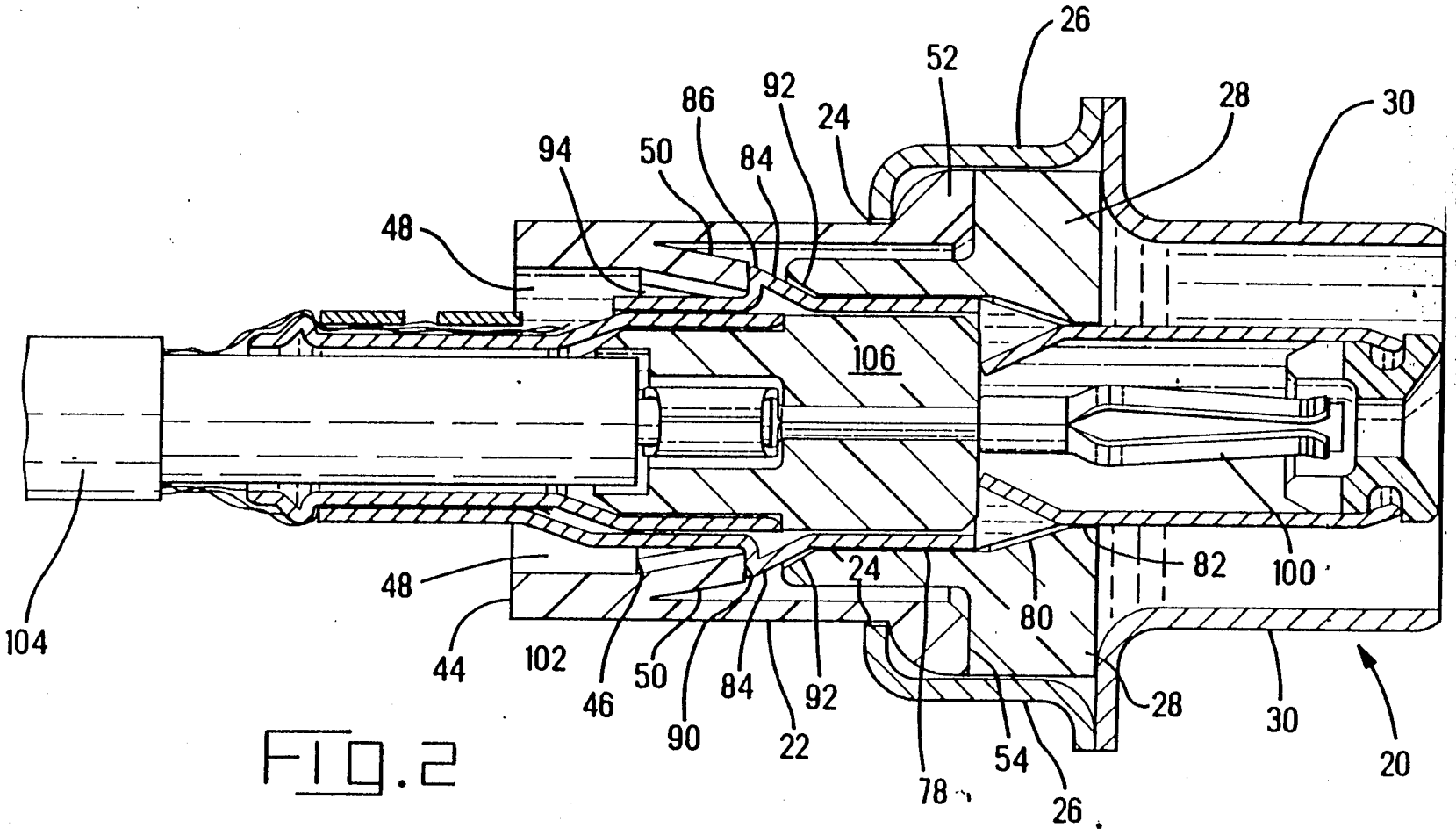
FIG. 2 is a partial cross section, similar to FIG. 1, through a connector plug housing showing a plug coaxial contact secured in the connector housing.
Figure 3:
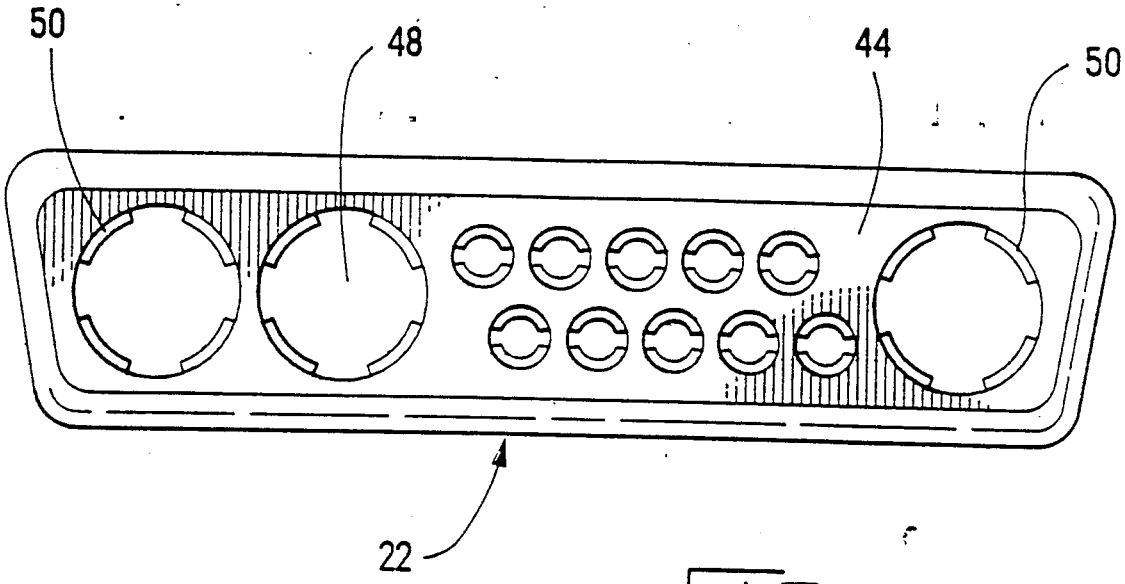
FIG. 3 is a bottom view of the rear insert for a plug housing showing the coaxial contact retention tines extending into the profile of the contact passage.
Figure 4:
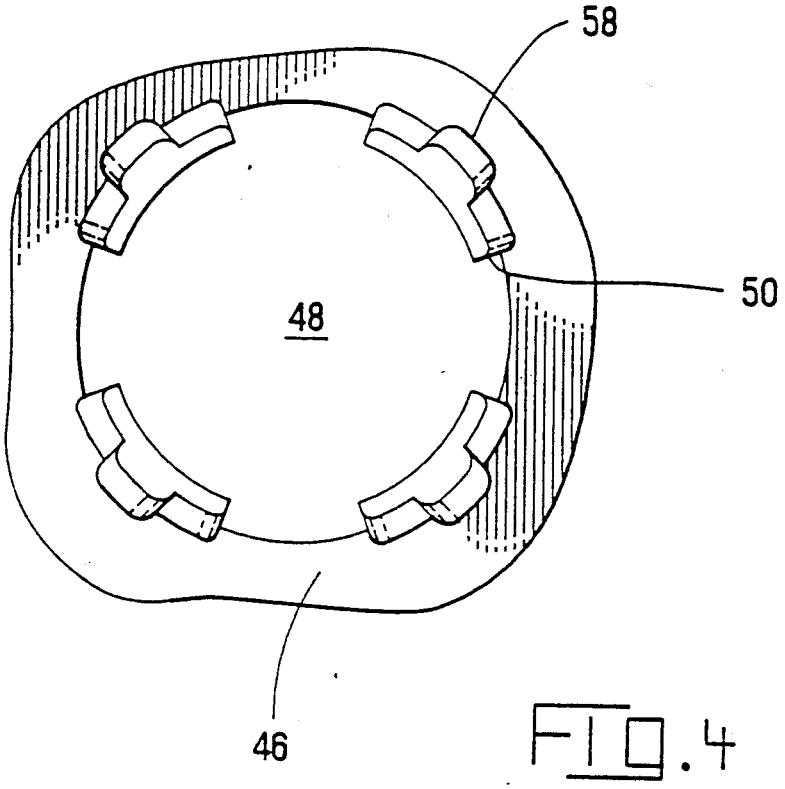
FIG. 4 is a partial top view of the rear insert showing the contact retention tines extending into the profile of the contact passage.

Extending forwardly from forward face 46 (upward in FIGS. 1 and 2) are tines 50. Each tine 50 is a hollow split frustoconical structure substantially axially aligned with a contact receiving passage 48. Tines 50 are distributed circumferentially of respective coaxial contact receiving passages 48 and converge radially of respective passageways in the direction of insertion of a coaxial contact. Each contact receiving passage typically has four tines as best seen in FIGS. 3 and 4. Tines 50 extend into the profile of passages 48 as best seen in FIGS. 1–5. Converging tines 50 are resiliently deflectable and form at the ends 56 thereof a restricted orifice. Each tine 50 may have a vertical rib 58 (see FIG. 4) extending along the conical surface. Ribs 58 provide lateral support for tine 50 during insertion of a coaxial contact 60 as well as subsequent to insertion of coaxial contact 60 to retain coaxial contact 60 secured in position. Ribs 58 further provide a path for insulative material to flow into and fill the tine during molding of rear insert 22.

Forward insert 28 has a corresponding axially lined coaxial contact receiving passage 66 extending therethrough between mating face 36 and rear face 68. Forward insert 28 is positioned relative to rear insert 22 by peripheral flange 70 and engaging upper surface 54 flange 52 on rear insert 22. Passage 66 in the receptacle coaxial contact 20 shown in FIG. 1 has a rear portion 72 with an inside diameter that is substantially the outside diameter of shell 74 so as to closely receive shell 74 and maintain shell 74 and hence contact 60 in predetermined alignment with respect to connector 20. The forward portion of passage 66 is slightly larger than shell 74 to permit radially outward deflection of beams 76 at the forward end of shell 74 upon mating with a plug contact. Similarly, passage 66 in the plug coaxial contact shown in FIG. 2 has a wider rear portion 78, a tapered conical section 80 and a narrower forward portion 82, each of which contribute to maintain in the shell of the plug coaxial contact in predetermined alignment with connector 20.

Figure 5:
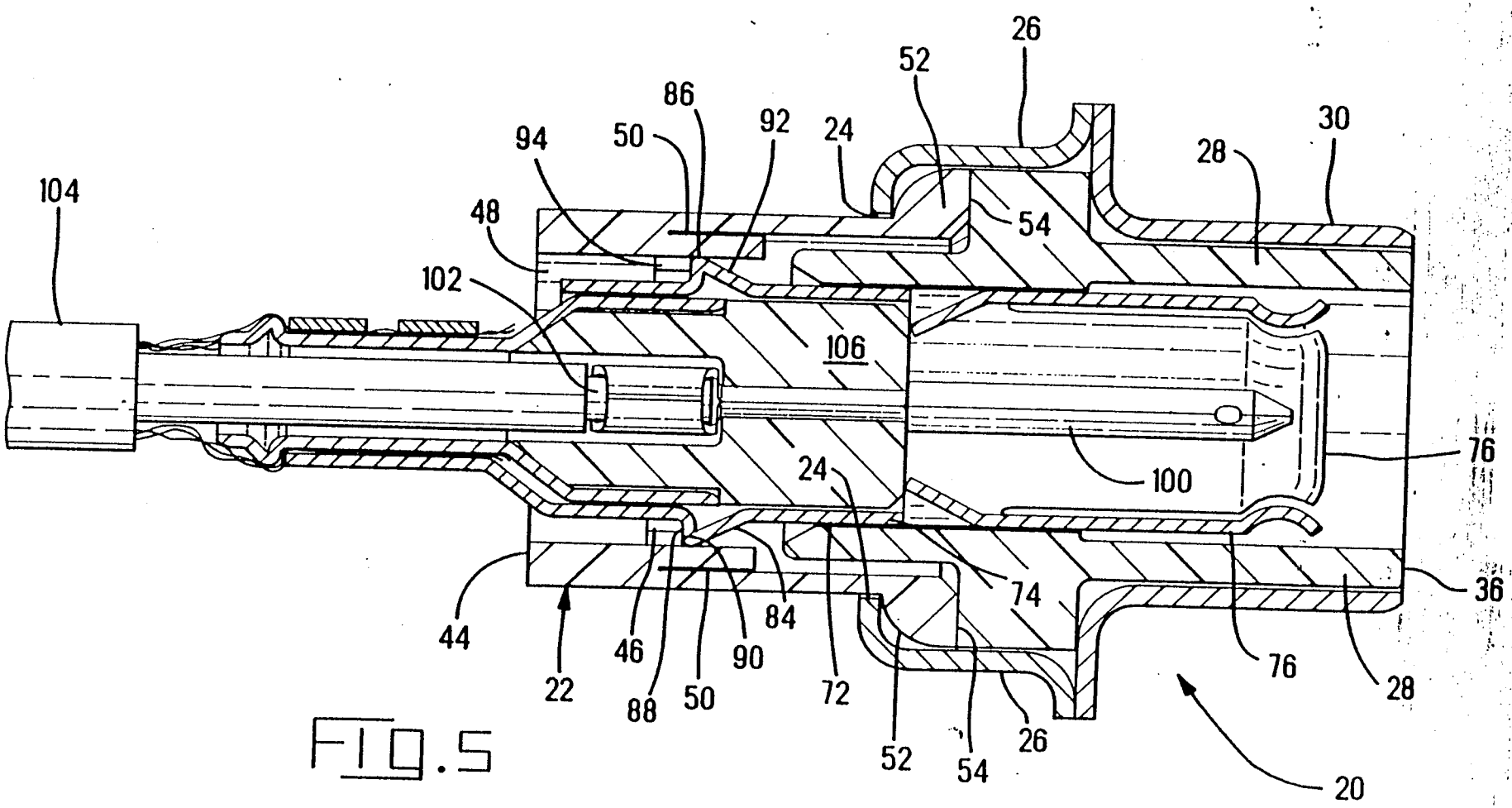
FIG. 5 is a partial cross section of a coaxial contact partially inserted into a passage showing deflection of the tines.
Figure 6:
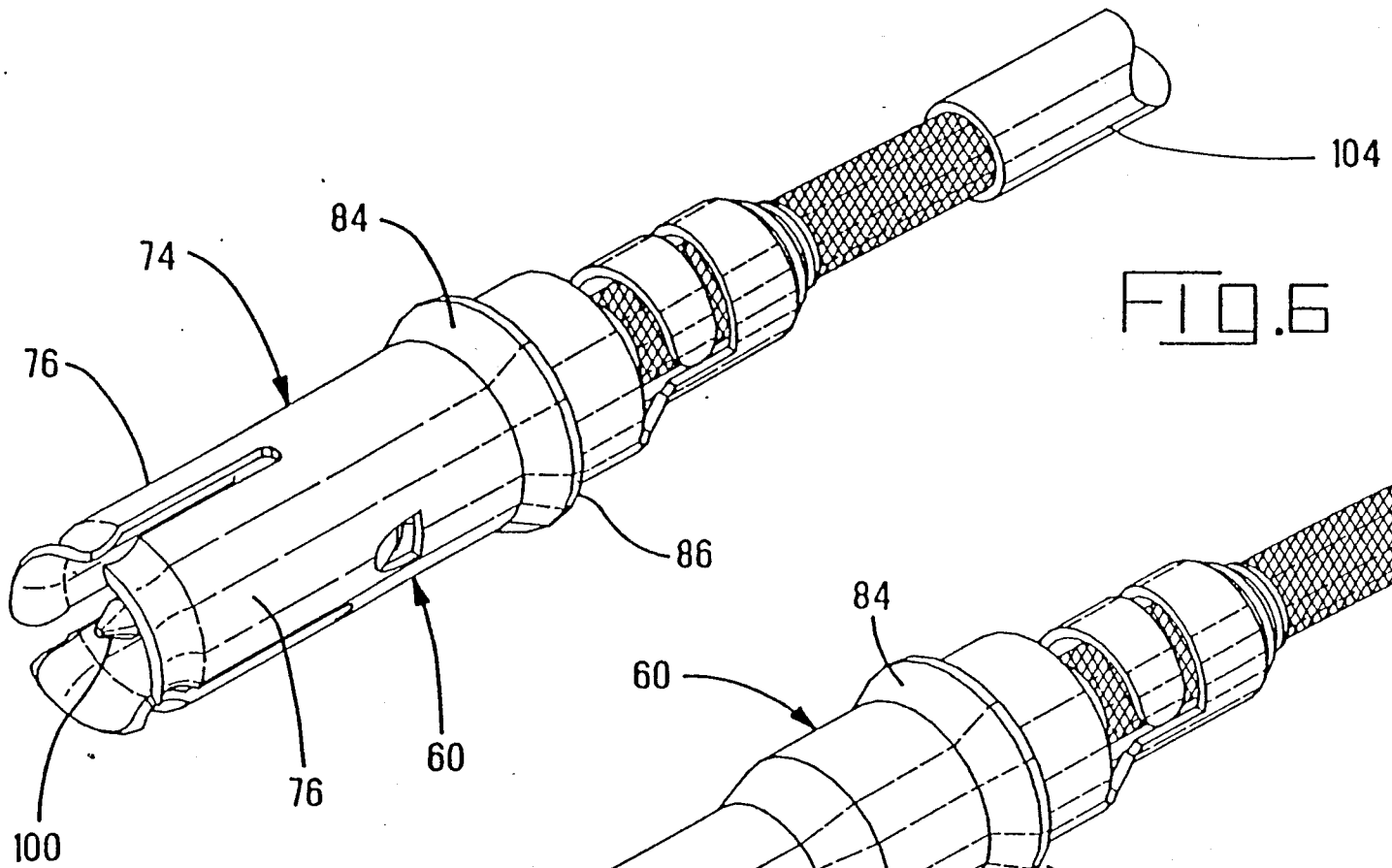
FIG. 6 is a perspective view of a receptacle coaxial contact.
Figure 7:
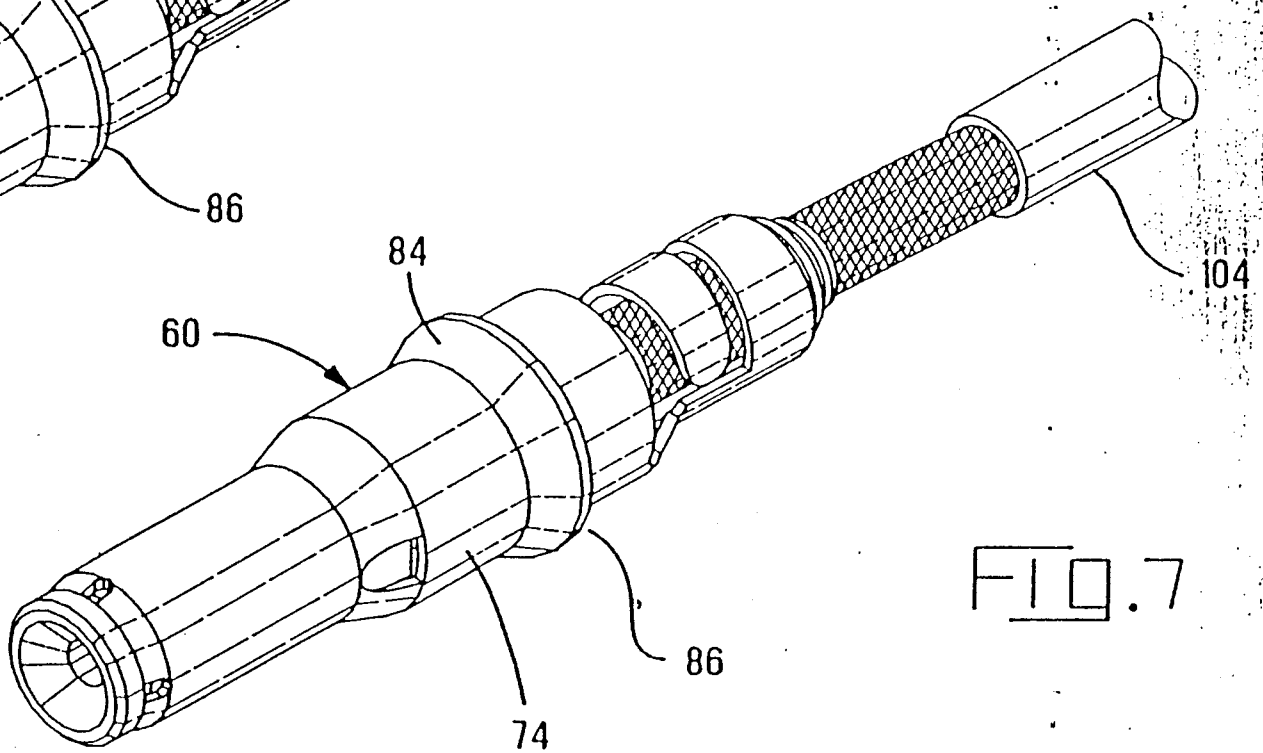
FIG. 7 is a perspective view of a plug coaxial contact.

As best seen in FIG. 5, coaxial contact 60 is inserted into aligned passages 48 and 66 from rear face 44. During insertion, tines 50 flex outwardly riding over the formed conical surface 84 of shell 74. Conical surface 84 extends to the largest diameter at apex 86 and defines rearwardly facing annular surface 88. Coaxial contact 60 is inserted into passages 48 and 66 until surface 84 engages bevel 92 surrounding passage 66 in forward insert 28. As apex 84 passes the ends 90 of tines 50, tines 50 resile inwardly to engage annular surface 88 thereby securing coaxial contact 60 in connector 20 between front insert 28 and rear insert 22 with conical surface 84 engaging bevel 92 and ends 90 of tines 50 engaging annular surface 88.

Coaxial contact 60 remains in connector 20 when subjected to axial forces that would tend to back the contact out of the connector, such as during meeting with a complimentary connector, as surface 88 engages ends 90 of tines 50. Coaxial contact 60 is removable by inserting a tool from rear face 44 into passage 48 and specifically into gap 94 between shell 74 and tines 50 to simultaneously spread all tines securing a coaxial contact 60 until apex 86 clears the ends 90 of tines 50, whereupon coaxial contact 60 can be removed from connector 20 in a direction opposite to insertion.

Coaxial contact 60 has a center contact 100 for termination to the center conductor 102 of a coaxial cable 104. The center contact 100 is disposed concentrically within conductive shell 74 and insulated therefrom such as by dielectric member 106. The center contact may be a pin as shown in the receptacle coaxial contact 60 of FIG. 1 or a receptacle as shown in the plug coaxial contact as shown in FIG. 2. The plug and receptacle contacts are described in more detail in concurrently filed, copending application ser. No. 07/531,192 entitled Fordable Dielectric Insert for Coaxial Contact and application Ser. No. 07/531,204 entitled Tapered Lead-in Insert for a Coaxial Contact, each of which is incorporated herein by reference.

Connector 20 may have other contacts 110 that are not coaxial contacts, giving rise to the name of a coax mix connector. In the preferred embodiment, contacts 100 are stamped in formed contacts, may be pins or receptacles and may be retained in any known manner, such as the retention system taught by U.S. Pat. No. 4,749,373, the disclosure of which is hereby incorporated by reference.

While surface 88 has been described as an annularly surface and surface 90 has been described as a conical surface, the invention is not limited thereto.

While the preferred embodiment discloses a coaxial contact secured in a cable connector using the snap-in retention system in accordance with the present invention, the invention can also be employed in board mount connectors.

Figure 12:
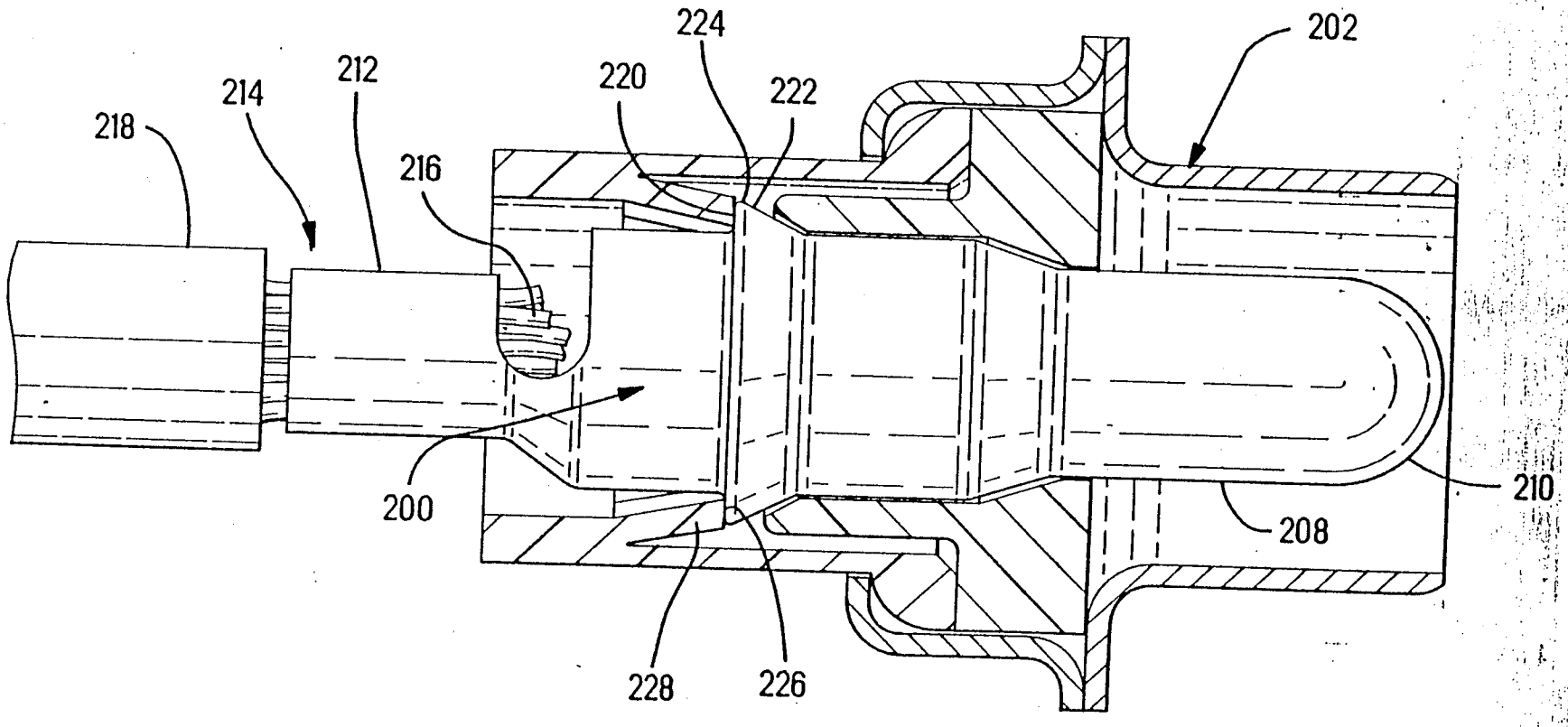
FIG. 12 is an alternate embodiment plug contact for power applications.
Figure 13:
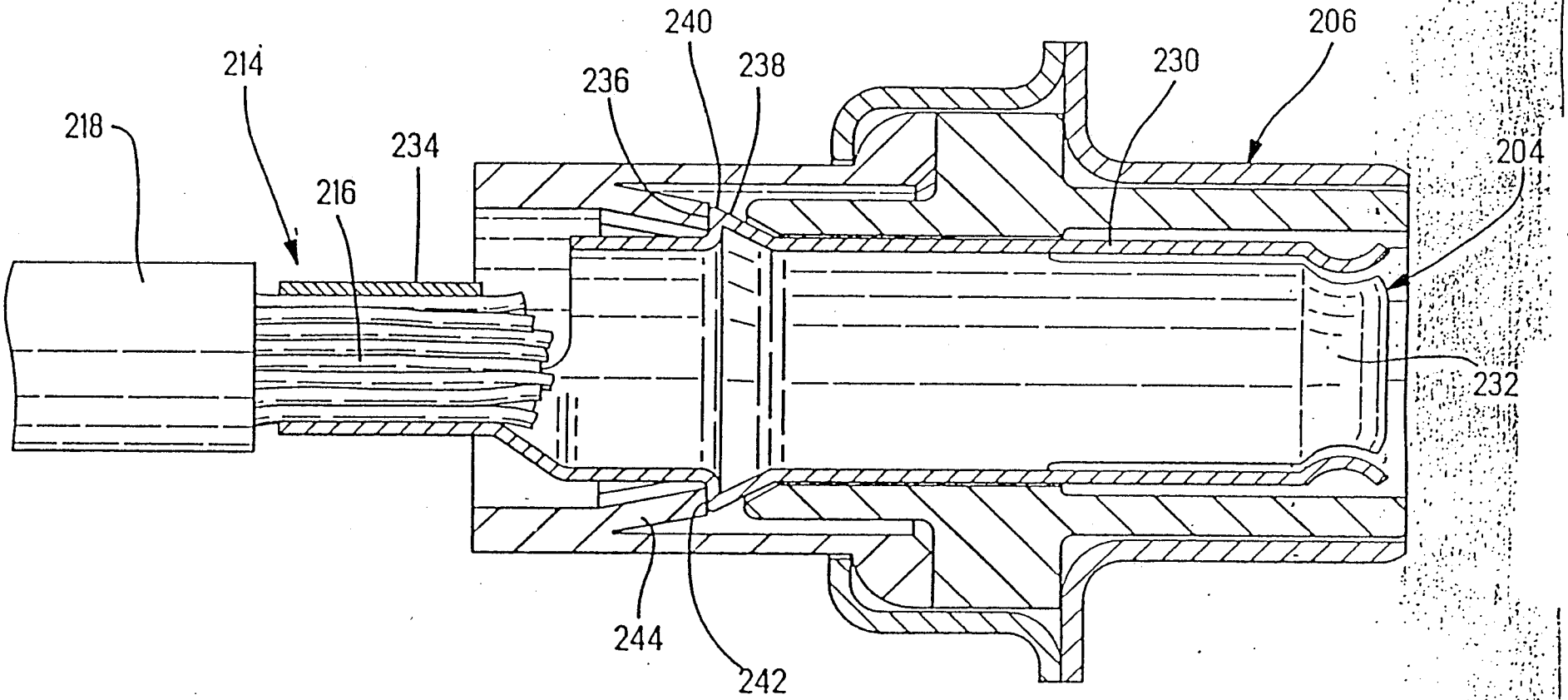
FIG. 13 is an alternate embodiment receptacle contact for power applications.

An alternate embodiment plug contact 200 for power applications is shown in a side view in FIG. 12 secured in a connector 202 shown in cross section. An alternate embodiment receptacle contact 204 for power applications is shown in cross section in FIG. 13 secured in a connector 206 also shown in cross section. Connectors 204 and 206 may be substantially like connectors 20 described above.

Plug contact 200 is very similar to the plug shell shown in FIG. 2. Plug contact 200, however, does not require stops to secure dielectric member 106. Plug contact 200 has a tubular forward section 208 terminating in a closed front end 210 that is tapered to facilitate mating and alignment. In the preferred embodiment, end 210 is hemispherical.

Contact 200 has crimp tabs 212 adapted to be crimped to a power conductor 214 having conductive strands 216 surrounded by insulative jacket 218. Since contact 200 does not have a center contact, dielectric member 106 is not required. Furthermore the ferrule is not required. Contact 200 is hollow inside.

Contact 200 has a rearwardly facing annular surface 220 extending radially outwardly from tubular forward section 208 and a formed conical surface 222 extending forwardly and radially inwardly from apex 224. Surface 220 cooperates with end 226 of tine 228 to retain contact 200 in connector 202.

Figure 1:
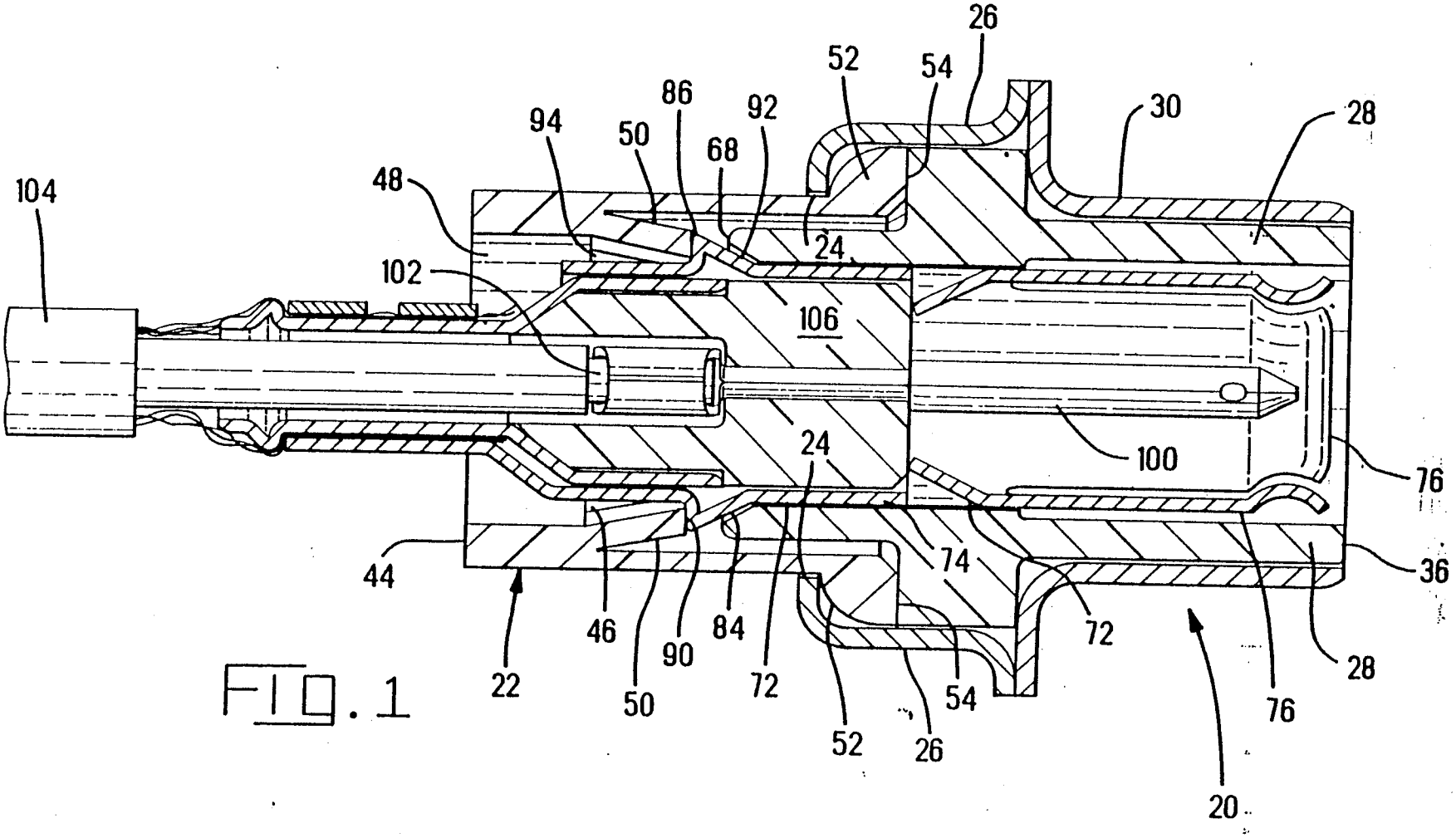
FIG. 1 is a partial cross section through a receptacle connector showing a receptacle coaxial contact secured in a connector housing in accordance with the present invention.

Receptacle contact 204 is very similar to the receptacle shell shown in FIG. 1. Receptacle contact 230 does not have a center contact, or dielectric insert or stops to position the dielectric insert within. Contact 204 has a tubular forward section 230 terminating in an open end 232 adapted to receive tubular forward section 208 of contact 200 during mating.

Contact 204 has crimp tabs 234 (shown in cross section) adapted to be crimped to a power conductor 214 having conductive strands 216 surrounded by insulative jacket 218. Since contact 204 does not have a center contact, dielectric member 106 is not required. Furthermore the ferrule is not required. Contact 204 is hollow inside.

Contact 204 has a rearwardly facing annular surface 236 extending radially outwardly from tubular forward section 203 and a formed conical surface 238 extending forwardly and radially inwardly from apex 240. Surface 238 cooperates with end 242 of tine 244 to retain contact 204 in connector 206.

What is claimed is:

1. An electrical connector, comprising:

an insulative first housing member for receiving at least one coaxial contact, said first housing member having a forward face, a coaxial contact receiving face, and at least one coaxial contact receiving passage extending therebetween, said first housing member having at least one resiliently deflectable tine extending from the forward face, said at least one tine axially aligned with said at least one coaxial contact receiving passage and extending angularly toward each other into the profile of said passage; and an insulative second housing member, the second housing member for engaging the first housing member, for receiving at least one coaxial contact and for securing said at least one coaxial contact in the first and second housing members, said second housing member having at least one coaxial contact receiving passage corresponding in location to said at least one coaxial contact receiving passage in said first housing member, whereby a coaxial contact axially received in said at least one coaxial contact receiving passage is secured between the first and second housing members.

2. An electrical connector as recited in claim 1, further comprising electrically conductive shell means surrounding a mating face for shielding the mating face and for engaging shield means of a complementary connector.

3. An electrical connector as recited in claim 1, further comprising flange means having an aperture therein for receiving mounting means to secure the connector to a complementary connector.

4. An electrical connector as recited in claim 1, wherein the tines are integrally molded with said first dielectric housing.

5. An electrical connector as recited in claim 1 wherein the connector comprises four tines.

6. An electrical connector as recited in claim 1, further comprising a coaxial contact received in the coaxial contact receiving passages of said first and second housing members, said coaxial contact having a center contact, dielectric means concentrically encircling the center contact and an electrically conductive shell surrounding said dielectric means, said shell having a surface facing rearwardly of said contact, said surface adapted to engage the end of said at least one tine to releasably secure the coaxial contact in said at least one coaxial contact receiving passage.

7. An electrical connector as recited in claim 6, wherein said surface is annular.

8. An electrical connector as recited in claim 7, further comprising a conical surface extending from the annular surface forwardly to the shell, whereby during insertion of the coaxial contact into the coaxial contact receiving passage, the tines engage the conical surface and flex outwardly until the annular surface passes the ends of said tines whereupon the tines resile inwardly to secure the coaxial contact in said at least one coaxial contact receiving passage of the connector.

9. An electrical connector, comprising:

a dielectric housing for receiving at least one coaxial contact, said housing having at least one coaxial contact receiving passage and at least one tine extending angularly into the profile of said passage;

a coaxial contact received in said at least one coaxial contact receiving passage, said coaxial contact having an electrically conductive shell with an electrically isolated concentric center contact therein, said shell having a surface facing rearwardly of said contact, said surface adapted to engage the end of said at least one tine to releasably secure the coaxial contact in said at least one coaxial contact receiving passage.

10. An electrical connector as recited in claim 9, wherein the tines are integral with said housing.

11. An electrical connector as recited in claim 9, wherein the center contact is a pin contact.

12. An electrical connector as recited in claim 9, wherein the center contact is a receptacle contact.

13. An electrical connector as recited in claim 9, further comprising additional contacts secured in said housing.

14. An electrical connector as recited in claim 9, wherein said surface is annular.

15. An electrical connector as recited in claim 14, further comprising a conical surface extending from the annular surface forwardly to the shell, whereby during insertion of the coaxial contact into the coaxial contact receiving passage the tines engage the conical surface and flex outwardly until the annular surface passes the ends of said tines whereupon the tines resile inwardly to secure the coaxial contact in said at least one coaxial contact receiving passage of the connector.

16. A coax mix connector, comprising:

an insulative housing for receiving at least one coax contact and at least one non-coax contact, said housing having at least one coax contact receiving passage having a pair of tines extending angularly toward each other into the profile of said at least one coax contact receiving passage, said housing having at least one non-coax contact receiving passage having said non-coax contact secured therein; and a coaxial contact received in said at least one coaxial contact receiving passage, said coaxial contact having an electrically conductive shell with an electrically isolated concentric center contact therein, said shell having a surface facing rearwardly of said contact, said surface adapted to engage ends of said tines to releasably secure the coaxial contact in said at least one coaxial contact receiving passage.

17. An electrical connector as recited in claim 16, wherein the center contact is a pin contact.

18. An electrical connector as recited in claim 16, wherein the center contact is a receptacle contact.

19. An electrical connector, comprising:

a dielectric housing for receiving at least one terminal member, said housing having at least one terminal member receiving passage and at least one tine extending angularly into the profile of said passage;

a terminal member received in said at least one terminal receiving passage, said terminal member having a tubular forward section for mating with a corresponding terminal and a conductor securing section, said tubular section defining a surface facing rearwardly of said contact, said surface positioned along said forward surface and adapted to engage the end of said at least one tine, said conductor securing section adapted to be secured to a conductor, whereby the terminal member is releasably secured in said at least one terminal member receiving passage.

20. An electrical connector as recited in claim 19. wherein the tubular forward section defines a closed end.

21. An electrical connector as recited in claim 19, wherein the tubular forward section defines an open end.

22. An electrical connector as recited in claim 19, wherein the conductor securing section of the terminal member includes at least one crimp tab, the terminal member comprising a power terminal adapted to be terminated to a power electrical conductor by crimping.

23. An electrical connector as recited in claim 19, wherein the tubular forward section is electrically conductive and the terminal member further comprises a center contact, said center contact disposed concentrically in said tubular forward section and isolated therefrom.

* * * * *